US006423184B2

(12) United States Patent
Vähätalo et al.

(10) Patent No.: US 6,423,184 B2
(45) Date of Patent: Jul. 23, 2002

(54) METHOD AND EQUIPMENT FOR REGULATION OF THE INITIAL PART OF THE DRYER SECTION IN A PAPER MACHINE

(75) Inventors: Harri Vähätalo; Juha Kaihovirta, both of Jyväskylä; Juha Lipponen, Kerava; Taisto Huhtelin, Tampere, all of (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/867,925

(22) Filed: May 30, 2001

Related U.S. Application Data

(63) Continuation of application No. PCT/FI99/00990, filed on Nov. 29, 1999.

(30) Foreign Application Priority Data

Dec. 4, 1998 (FI) ..... 982622

(51) Int. Cl.[7] ..... D21F 5/06

(52) U.S. Cl. ..... 162/198; 162/253; 162/263; 162/DIG. 10; 34/446; 34/526

(58) Field of Search ..... 162/198, 252, 162/253, 258, 259, 262, 264, 263, 358.1, 358.5, 359.1, 205, 206, 207, DIG. 10, DIG. 6; 700/122, 127, 128, 129; 34/108, 111, 113, 114, 116, 119, 123, 445, 446, 454, 459, 483, 484, 485, 491, 493, 497, 524, 526, 528, 549, 575

(56) References Cited

U.S. PATENT DOCUMENTS

| | | | | |
|---|---|---|---|---|
| 2,659,987 A | | 11/1953 | Bennett | |
| 3,016,622 A | | 1/1962 | Gade et al. | |
| 3,156,540 A | | 11/1964 | Baert | |
| 3,619,359 A | * | 11/1971 | Keyes | 162/252 |
| 3,666,621 A | * | 5/1972 | Adams | 162/198 |
| 3,748,224 A | * | 7/1973 | Tillie et al. | 162/252 |
| 3,864,842 A | * | 2/1975 | Sawyer | 34/446 |
| 4,314,878 A | * | 2/1982 | Lee | 162/198 |
| 4,701,857 A | * | 10/1987 | Robinson | 364/477 |
| 5,377,428 A | * | 1/1995 | Clark | 34/446 |
| 5,535,527 A | | 7/1996 | Virta et al. | |

FOREIGN PATENT DOCUMENTS

| | | |
|---|---|---|
| EP | 0 796 587 A2 | 4/1997 |
| EP | 0 844 084 A1 | 5/1998 |
| EP | 0 908 555 A2 | 4/1999 |

OTHER PUBLICATIONS

International Search Report issued in PCT/FI99/00990.
The National Board of Patents and Registration Official Action dated Jul. 15, 1999.
The National Board of Patents and Registration Official Action of Approval dated Dec. 28, 1999.
The National Board of Patents and Registration Communication dated Feb. 24, 2000.
Paper Technology, Jun. 1998 Technical News, p. 17.

* cited by examiner

*Primary Examiner*—Peter Chin
*Assistant Examiner*—Eric Hug
(74) *Attorney, Agent, or Firm*—Lathrop & Clark LLP

(57) ABSTRACT

A method and an equipment for regulation of the initial part of the dryer section in a paper machine. Moisture is removed from the paper web in the press section (10) and the paper web is dried in the dryer section (R). The paper web is dried against heated faces of drying cylinders (20). The surface temperatures of the first drying cylinders (20) in the dryer section (R) are measured. The dry solids content/moisture content of the paper web (W) and the temperature of the paper web (W) before said first drying cylinders (20) are measured. In view of producing the desired running situation, based on the measurement results obtained, the surface temperatures of said first drying cylinders (20) and/or the dry solids content/moisture content and/or the temperature of the paper web (W) before said first drying cylinders (20) is/are regulated.

21 Claims, 3 Drawing Sheets

METHOD AND EQUIPMENT FOR REGULATION OF THE INITIAL PART OF THE DRYER SECTION IN A PAPER MACHINE

CROSS REFERENCES TO RELATED APPLICATIONS

This application is a continuation of PCT application No. PCT/F199/00990, filed Nov. 29, 1999, and claims priority on Finnish Application No. 982622, Filed Dec. 4, 1998, the disclosures of both of which applications are incorporated by reference herein.

STATEMENT AS TO RIGHTS TO INVENTIONS MADE UNDER

FEDERALLY SPONSORED RESEARCH AND DEVELOPMENT

Not applicable.

BACKGROUND OF THE INVENTION

The invention concerns a method for regulation of the initial part of the dryer section in a paper machine, in which method moisture is removed from the paper web in the dryer section and in which method the paper web is dried in the dryer section, in which method the paper web to be dried is passed from the press section into the dryer section into the first group of drying cylinders, in which the paper web is dried against heated faces of drying cylinders.

Further, the invention concerns an equipment for regulation of the initial part of the dryer section in a paper machine, which equipment has been fitted in connection with the press section and with the dryer section in the paper machine.

As is known from the prior art, in multi-cylinder dryers in paper machines, twin-wire draw and/or single-wire draw is/are employed. In twin-wire draw the groups of drying cylinders comprise two wires, which press the web, one from above and the other one from below, against heated cylinder faces. In twin-wire draw, between the rows of drying cylinders, which are usually horizontal rows, the web has free and unsupported draws, which are susceptible of fluttering, which may cause web breaks, in particular in the stages of drying in which the web is still relatively moist and, therefore, of low strength. This is why, in the course of the last 15 years, ever increasing use has been made of the single-wire draw, in which each group of drying cylinders comprises just one drying wire, on whose support the web runs through the whole group so that the drying wire presses the web on the drying cylinders against heated cylinder faces, and on the reversing cylinders or rolls placed between the drying cylinders the web remains at the side of the outside curve. Thus, in single-wire draw, the drying cylinders are placed outside the wire loop and the reversing cylinders or rolls inside the loop. In order to heat the faces of the drying cylinders, steam is passed into their interior, and the temperature of the surface of a heated drying cylinder is regulated so that the pressure of the steam present in the interior of the cylinder is regulated.

In view of the cylinder drying and in view of the runnability of the paper web and of the quality properties of the paper, the first drying cylinders placed in the beginning of the dryer section are highly important. If the temperatures of the first drying cylinders are too high, the paper web has a tendency to follow the face of the cylinder, which causes problems of runnability and thereby restricts the running speed. Likewise, the brightness of the paper web becomes lower, the porosity increases, the roughness increases, formation of dust increases, and the bulk may become lower. On the other hand, if the temperatures of the first drying cylinders are too low, the drying cylinders in the initial part of the dryer section are inefficient.

During threading of the web, even though the steam pressure has normally been switched off for this time or the steam pressure has been lowered to a level lower than a normal running situation in respect of the cylinders in the initial part of the dryer section, most commonly by lowering the pressure in the principal steam group, the lead-in strip has adhered to the drying cylinders, because the faces of the first drying cylinders are hot since the energy-consuming paper web is not present on them, in which case, thus, the web does not consume the thermal energy of the drying cylinders. Adhering of the lead-in strip has caused threading problems and thereby lowered the efficiency of the paper machine.

In the prior-art multi-cylinder dryers, in the initial part of the dryer section, it has been a further problem that it has not been possible to use a temperature sufficiently high in view of optimal drying, because, when the paper web is in direct contact with the hot faces of the drying cylinders, at temperatures higher than a certain level the web tends to adhere to the hot faces of the cylinders, which results in web breaks and standstills. It has also been noticed that excessively hot contact drying cylinders have detrimental effects on the quality properties of the paper. On the other hand, excessively low temperatures result in lowered drying efficiency.

At the first drying cylinders, problems have also arisen from the fact that, when the paper web starts becoming warm, it stretches, and when it stretches, it loses some of its tension, in which connection the web tends to follow the drying cylinder, which may cause problems of runnability. Traditionally, these problems have been solved so that a difference in speed has been arranged between the press section and the dryer section in order to maintain the web tension. Further, differences in speed have been employed between the first dryer groups in order to produce an adequate tension. However, excessive differences of draw have negative effects on the properties of the final product, because, when the paper is pulled, in particular its strength properties both in the machine direction and in the cross direction change.

One prior-art solution of the type described above is known from the publication EP 0,769,587. In said prior-art arrangement the draw applied to the web is increased constantly so that a number of short dryer groups arc employed in the initial part of the dryer section, which is unfavourable in view of the costs, because, among other things, extra drives, wires and wire guides are needed.

Important factors which affect the temperatures of the first cylinders in a dryer section include, among other things, the paper grade to be produced, the web moisture after the press section, and the temperature of the paper web. Usually, information on these factors in combination with the steam pressures in the first drying cylinders employed in cylinder drying has been obtained empirically only.

The current development in paper manufacture is about to lead in a situation in which there is no open draw between the press section and the dryer section, but a closed draw is concerned, in which case no high differences in speed can be employed, for which reason the problems described above in relation to the stretch of the web are emphasized.

SUMMARY OF THE INVENTION

The object of the present invention is to provide a solution for the problems described above.

It is a further object of the invention to provide a drying method and a dryer section that makes use of said method in which adhering of the web to the cylinders in the initial end of the dryer section is prevented and in which, at the same time, improved quality of the paper and improved runnability of the paper machine are achieved.

In view of achieving the objectives stated above and those that will come out later, the method in accordance with the invention is mainly characterized in that, in the method, the surface temperatures of the first drying cylinders in the dryer section are measured, that, in the method, the dry solids content/moisture content of the paper web and the temperature of the paper web before said first drying cylinders are measured, and that, in the method, in view of producing the desired running situation, based on the measurement results obtained, the surface temperatures of said first drying cylinders and/or the dry solids content/moisture content and/or the temperature of the paper web before said first drying cylinders is/are regulated.

On the other hand, the dryer section in accordance with the invention is mainly characterized in that the equipment comprises measurement devices fitted in connection with the first drying cylinders in the dryer section for measurement of the surface temperatures of said first drying cylinders, a measurement device for measurement of the dry solids content/moisture content of the paper web and of the temperature of the paper web before said first drying cylinders, and a control device for regulation of the surface temperatures of said first drying cylinders and/or of the dry solids content/moisture content and/or of the temperature of the paper web before said first drying cylinders, based on the measurement results obtained by means of the measurement devices, to produce the desired running situation.

In accordance with the invention, the surface temperatures of the first drying cylinders in the dryer section and the dry solids/moisture content of the paper web and the temperature of the web before the first drying cylinders are measured, and on the basis of the measurement results the surface temperatures of the first drying cylinders are regulated to the desired level so that a good running situation is achieved.

Besides by means of the steam pressure/flow, the surface temperatures of the first drying cylinders can, of course, also be regulated by means of other known methods, for example by means of induction heating or by means of electrical resistors.

The highest possible difference in temperature that provides good runnability depends on a number of different factors: paper grade and basis weight, stock that is used, web temperature, moisture content, fiber orientation, and machine speed. This is why it is often not possible to present a precise model for a correct maximal difference in temperature, but the regulation algorithms must be based on empiric information. It is known that the strength properties of different paper grades depend on the fibrous raw-material that is used and on the various properties of said material. The fibrous raw-material, its grinding degree, and possible additives and fillers affect the tendency with which the web, when moist, attempts to adhere to a hot cylinder face. In practice, these are, however, factors which cannot be changed for the sake of the runnability in the initial part of the dryer section alone, but the decisive factor is the paper quality. The same is true concerning the fiber orientation, even though it is known that a highly oriented web would be stronger in the machine direction.

The web temperature has two factors which act in opposite directions. On one hand, it has been noticed that, when the web is hotter, it does not adhere to the first hot faces equally well. On the other hand, the web strength becomes lower when the temperature becomes higher. The machine speed does not have a direct intensive effect on the adhering of the web to the first cylinder, but, on the other hand, it produces a vacuum in the opening web-cylinder gap, as a result of which vacuum the web tends to follow the cylinder face. This diverts the web from the face of the support wire and, thus, subjects the web to centrifugal forces which are increased in direct proportion to the second power of the speed.

The web moisture has a great negative effect on the runnability of the initial part of the dryer section. First, experience has shown that a moist web has an intensive tendency to adhere to a cylinder face. In practice, this has caused, e.g., formation of dust and a so-called linting effect. On the other hand, the web strength becomes lower when the moisture content becomes higher.

A solution is included in the scope of the present invention in which a regulation model has been formed by using at least some of the parameters mentioned above and by regulating the surface temperatures of the first drying cylinders so that the difference between the temperatures of the cylinders and the web is smaller than the maximal temperature given by said model. In its simplest form, this model can have, for example, the following form:

$$\Delta Y = T0 - K*M, \text{ wherein}$$

T0 is an empiric invariable or an invariable determined by computing,

K is an empiric invariable or an invariable determined by computing, and

M is the moisture content of the web before the first cylinder.

One such equation of regulation might be $$\Delta T(^\circ\text{ C.}) = 48 - 5*M, \text{ wherein}$$

M is the moisture content of the web before the first cylinder as a percentage of the total weight of the web.

The equation is valid in the range 35%<M<60%

A form that is slightly more common is represented by $$\Delta T = T0(Tr;\ BW) - k1*f(M) - k2*f(v), \text{ wherein}$$

T0 is an invariable dependent on web temperature Tr and on basis weight BW, k1 and k2 are invariable coefficients, and (M) and f(v) are functions of web moisture M and on machine speed v.

An example of such a regulation model is the equation:

$$\Delta T(^\circ\text{ C.}) = 60 - 6*M - 0.01*v^2, \text{ wherein}$$

v is the machine speed (meters per second).

Of course, in its commonest form, the regulation model is, for each paper grade and paper quality to be produced, of the form:

$$\Delta T = \Delta T(Tr;\ v;\ M,\ BW),$$

but, as was stated earlier, this is often quite difficult to determine precisely.

The control algorithm solutions described above are also affected by limitations arising from quality factors, so that the initial part of the dryer section is quite significant from the point of view of the paper quality. In the initial part of the dryer section the web may end up in such a range of temperature-moisture that the fibers are softened. When the initial drying temperature becomes higher, among other things the following changes are noticed in the properties of the web: the coefficient of scattering of light becomes lower, the tensile strength and density become higher, the permeability to air is lowered, and the roughness of the surface is increased. At the same time the calendering quality of the paper is deteriorated. The magnitude of the effect depends on the yield of stock so that the effects are highest with mechanical pulps, but are reduced rapidly when the yield becomes lower. One consequence of the softening of the fibers by the effect of the drying temperature is adhering of fibers to the faces of the cylinders in the initial part of the dryer section if the temperatures of the cylinders are excessively high in the beginning, which effect occurs with printing papers that contain mechanical pulp. When the fibers adhere to the cylinders, they rise upright when the web is separated from the cylinder. This causes dust formation in the paper during printing. A certain contribution to such adhesion is given by various additives of paper, such as stock sizes. In accordance with the present invention, these factors present in the initial part of the dryer section are taken into account when the surface temperatures of the drying cylinders are regulated in accordance with the invention so that a good running situation is achieved.

The surface temperatures of the drying cylinders can be measured by means of IR measurements, for example by means of an IR camera, or by using particular apparatuses developed for measurement of the surface temperature of a cylinder. Such an apparatus has been described, for example in the journal *Paper Technology*, June 1998, page 17. From the prior art, various temperature detectors that reach contact with the face of a drying cylinder are also known.

After a paper web break, the steam pressures in the first cylinders are lowered from the level of a normal running situation. Based on the results obtained from measurements of the surface temperatures of the first drying cylinders, the surface temperatures of the first drying cylinders are regulated to a suitable level for the time of threading, and after threading the temperatures are raised, based on a predetermined sequence or on measurement of the ultimate dry solids content, to the level corresponding to the normal running situation. If necessary, the moisture content and the temperature of the lead-in strip before the first drying cylinders can be measured.

Based on the moisture content of the lead-in strip, the possibilities of success of the following threading can be estimated, because the moisture value predicts the runnability. An excessively moist lead-in strip is of low strength, and it adheres readily to the first drying cylinders. It also stretches easily and makes successful threading of the web more difficult.

Based on the measurement results, if necessary, it is also possible to regulate the press loads in the press section in order to obtain sufficient strength of the lead-in strip so as to provide a successful threading. In addition to this, based on the measurement results, it is possible to select suitable differences of draw between the press section and the dryer section and between the first groups in the dryer section as a function of the speed.

In accordance with a favourable additional feature of the invention, in the event of a web break, the steam pressures in the first cylinders are lowered in the usual way, and after this the evaporation load is equalized by moistening the wire. The web moisture and the web temperature preceding the first drying cylinders are measured after the web break in order that it should be possible to make the necessary corrections either by means of impingement drying, if there is an impingement drying unit in the initial part of the dryer section before the first drying cylinders, and/or by means of a steam box in the press section and/or by means of press loads. If the measurement also provides the cross-direction profiles of moisture and temperature, by means of said devices it is also possible to correct possible profile defects.

During normal running, based on the measurement results, it is possible to optimize the surface temperatures of the drying cylinders, the differences of draw in the initial part of the dryer section, and, if necessary, to change the press loads or to control the steam box of the press section so that an optimal running situation is achieved. Also, in a preferred embodiment of the present invention, based on the measurement results, it is possible to regulate the blow parameters of an impingement drying unit, which may have been fitted before the first drying cylinders, in compliance with the dry solids content and the temperature of the web.

In accordance with the invention, the surface temperatures of the first cylinders are monitored. The temperature is used as an indirect indicator of the conduct of the web on the cylinder concerned. Of course, it would also be possible to use, for example, apparatuses based on a video camera and picture processing, or a laser rangefinder, by whose means the conduct of the web in the opening wire-cylinder gap is monitored directly. Such a technology is, however, clearly more expensive and more complicated than measurement of temperature, and it is probable that even in such a case measurement of the surface temperature of the cylinder would be advantageous in view of regulation of the system.

In an additional embodiment of the invention, based on said measurements of the surface temperatures of the cylinders and/or on the measurements of the web moisture and/or web temperature, it is possible to regulate the vacuums at least in the first suction rolls and/or the capacities of the blow/suction boxes. With respect to the regulation of the vacuum, reference is made to U.S. Pat. No. 5,535,527. The applicant has noticed that, as a rule, when the web moisture and/or temperature become(s) higher, the web must be supported more efficiently in the initial part of the dryer section. The same is true regarding the surface temperature of a cylinder, but not to an equally great extent, in particular if the difference in temperature between the web and the cylinder is not excessively large.

In accordance with the present invention, the measurements can also be carried out with a web of full width in order that information could be obtained on the profile parameters of the web and that necessary regulation could be performed in respect of the profile properties of the web. In a preferred embodiment of the invention, the running parameters of the initial part of the dryer section are chosen on the basis of the most unfavourable point measured from the cross-direction profile.

In the following, the invention will be described with reference to the figures in the accompanying drawing, the invention being, however, not supposed to be strictly confined to the details of said illustrations.

DESCRIPTION OF THE PREFERRED EMBODIMENTS

Figure 1:
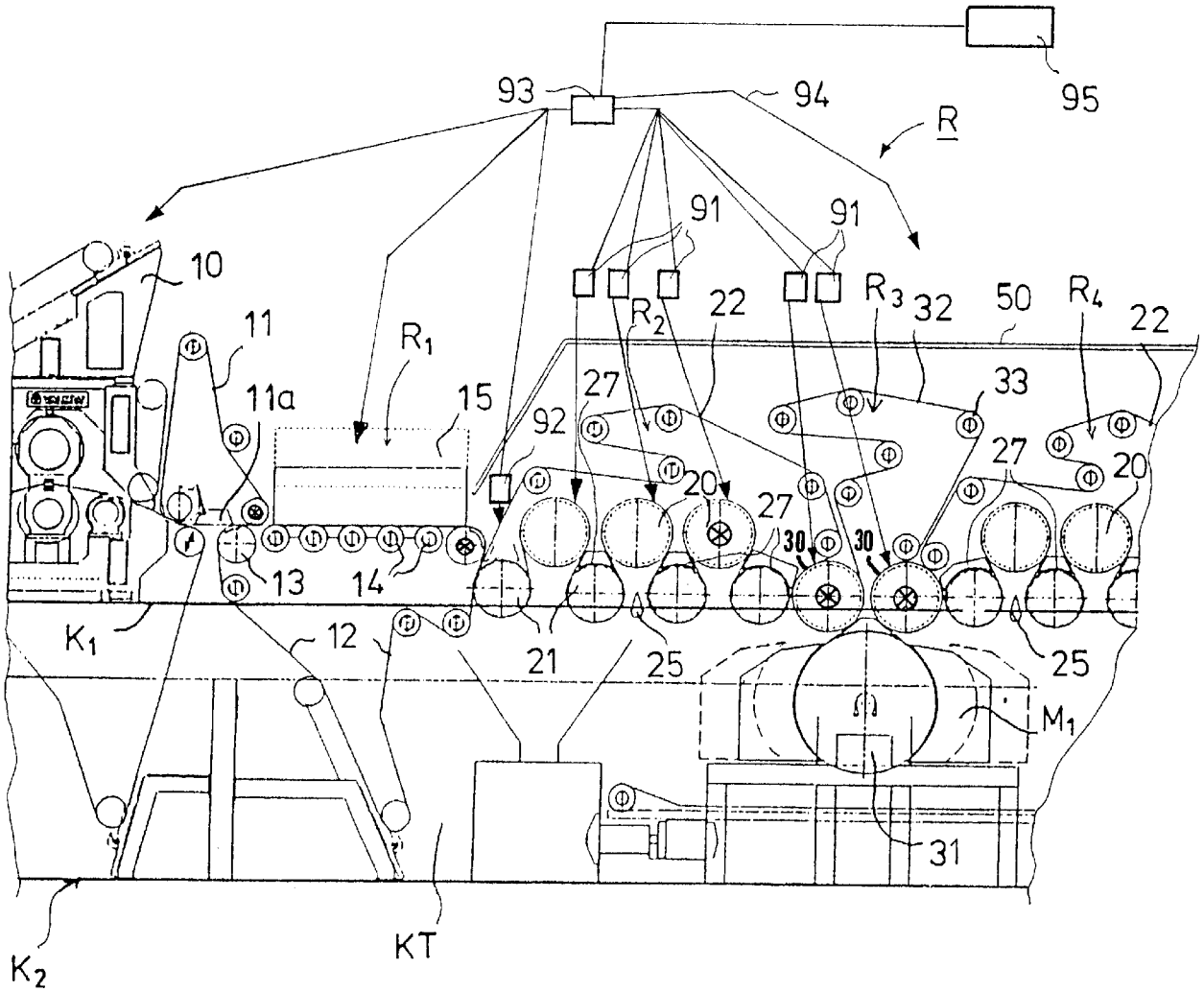
FIG. 1 is a schematic illustration of an initial part of a dryer section in which the regulation in accordance with the invention is applied, comprising an impingement drying unit between the press section and the cylinder drying.

FIG. 1 shows a preferred exemplifying embodiment of the invention, in which the paper web W is passed from the press section 10 of the paper machine on the bottom face of a transfer fabric 11, while supported by a PressRun™ box 11*a*, onto the top face of the drying wire or belt 12 over its guide roll 13. The planar drying unit $R_1$ comprises a blow hood 15, under which the web W to be dried runs on the horizontal run of the wire or belt 12, which run is supported by rolls 14. By means of the unit $R_1$, an intensive impulse of drying energy is applied to the web W. In the unit $R_1$ the paper web runs on support of the upper run of the drying wire 12 along a linear path in the horizontal plane so that it has no great changes in the direction and, thus, the web is not subjected to high dynamic forces, which might produce a web break in the web, which is still relatively moist and, therefore, of low strength. Inside the blow hood 15, there is a nozzle arrangement, by whose means hot drying gases, such as air or steam, are blown onto the top face of the web. Additionally, or alternatively, it is possible to use infrared heaters. Said blow devices and/or radiation devices in the unit $R_1$ can be arranged so that their capacity can be regulated in the cross direction of the web W in order to achieve cross-direction profiling of the web W.

In FIG. 1, the unit $R_1$ is followed by a first, so-called normal (not inverted) single-wire unit $R_2$, onto whose drying wire 22 the web W is transferred as a closed draw in the area of the first reversing suction roll 21. The single-wire unit $R_2$, and so also the following single-wire unit $R_4$ which is open towards the bottom, comprise steam-heated contact-drying cylinders 20 fitted in the upper row and reversing suction rolls 21 fitted in the lower row, for example Metso Paper, Inc.'s said VAC rolls™. Below the cylinders 20, there are doctors and ventilation blow devices 25. The paper web W to be dried enters into direct contact with the faces of the steam-heated drying cylinders 20, and on the reversing suction rolls 21 the web W remains at the side of the outside curve on the drying wire 22. In order to improve the runnability, blow boxes 27, for example the Metso Paper, Inc.'s UnoRunBlowBox blow boxes, have been fitted above the suction rolls 21. In the place of said boxes, it is, of course, possible to use suction boxes.

In FIG. 1, the group $R_2$ with single-wire draw is followed by a drying unit $R_3$, which comprises two contact-drying cylinders 30 and a large-diameter $D_1$ impingement-drying/through-drying cylinder 31 with a perforated mantle, which cylinder will be called large cylinder in the following. A drying wire 32 has been fitted to run around the contact-drying cylinders 30 and around the large cylinder 31, which drying wire 32 is guided by guide rolls 33. The impingement-drying/through-drying hood module $M_1$ of the drying unit $R_1$ has been fitted in the basement space KT below the floor level $K_1$ of the paper machine hall on the floor plane $K_2$ of said space KT. The central axes of the contact-drying cylinders 30 in the unit $R_3$ are placed substantially in, or in the vicinity of, the floor level $K_1$ of the paper machine hall, most appropriately slightly above said level. The paper web W to be dried is passed from the single-wire unit $R_2$ as a closed draw onto the first drying cylinder 30 in the drying unit $R_3$, after which the web W is passed on the wire 32 of the unit $R_3$ over the large cylinder 31 of the first module $M_1$ within a remarkably large sector on support of the drying wire 32, and further onto the second drying cylinder 30 in the unit $R_3$. From this drying cylinder 30 the web W is transferred as a closed draw into the following normal unit $R_4$ with single-wire draw, which unit is, for example, substantially similar to the unit $R_2$ described above. After this, there follow groups of drying cylinders and/or impingement-drying units. The drying units $R_3$,$R_4$ can also be, for example, substantially similar to the drying unit $R_2$ described above.

The press section shown in FIG. 1 has a drive of its own, so also the transfer belt, the planar dryer and all of the dryer groups following after it. A fabric is most commonly driven by means of a driven roll or rolls. In FIG. 1, and likewise in FIG. 2, driven rolls have been denoted with a mark Ⓧ applied to the shaft.

Figure 2:
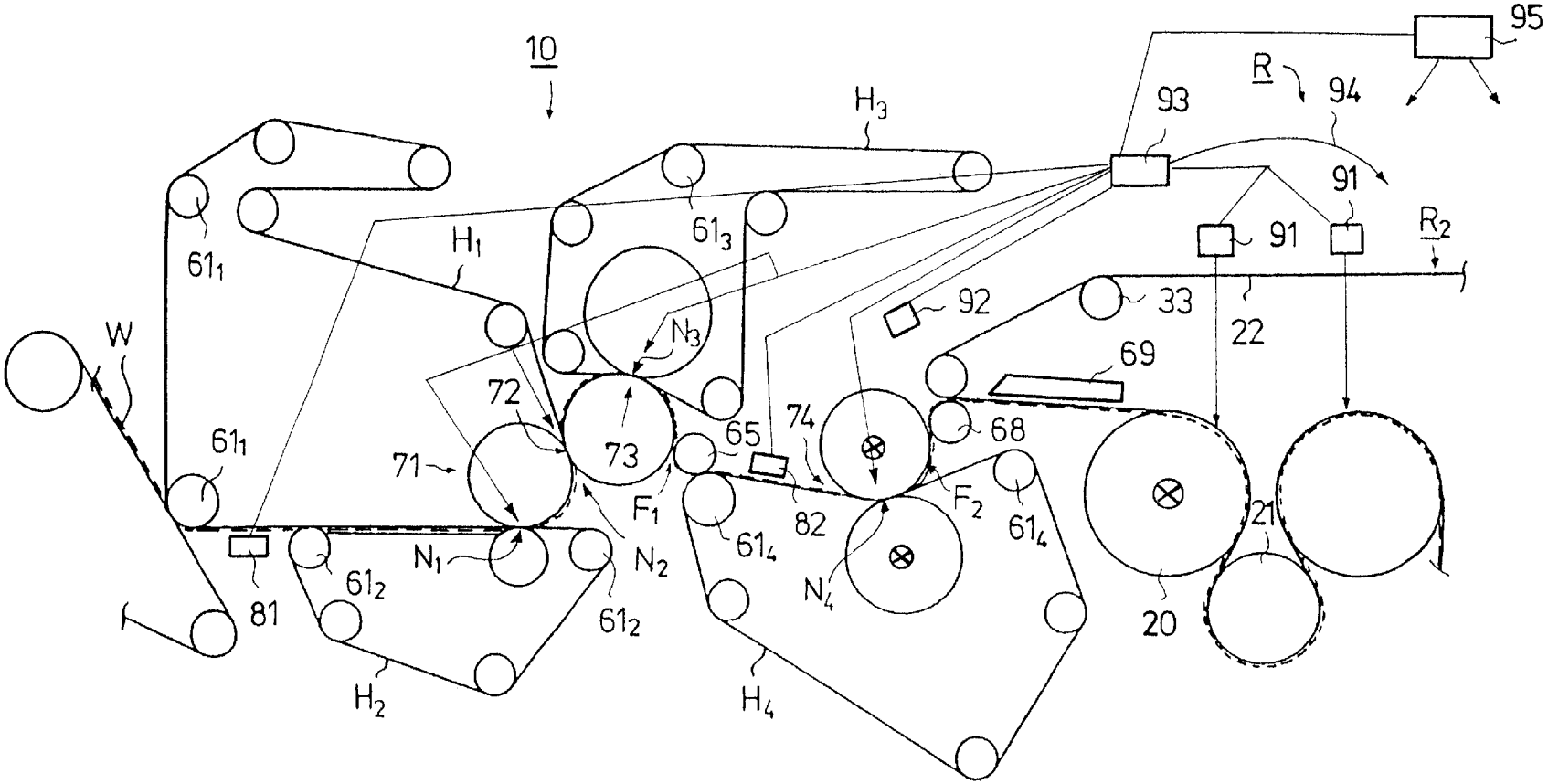
FIG. 2 is a schematic illustration of a press section and of an initial part of a press section following after the press section, wherein the regulation in accordance with the invention is applied.

FIG. 2 shows a second preferred exemplifying embodiment of the invention. The web W is passed between the felts $H_1$ and $H_2$ when it enters into the press section 10. The felt $H_1$ has been passed over felt guide rolls $\mathbf{61}_1$, and similarly the felt $H_2$ has been passed over felt guide rolls $\mathbf{61}_2$. The web W is passed into the first press 71 in the press 10. From the nip $N_1$ of the first press 71 the web is transferred further into the nip $N_2$ of the second press 72, and further into the nip $N_3$ of the third press 73 in the press section 10. After this the web W is transferred from the nip $N_3$ of the third press 73 through a free draw $F_1$ onto a transfer roll 65. The web W is guided further from the roll 65 into connection with a press felt $H_4$, and along with said felt into the nip $N_4$ of the fourth press 74. The felt $H_4$ has been passed over the felt guide rolls $\mathbf{61}_4$. Similarly, the felt $H_3$ has been passed over the felt guide rolls $\mathbf{61}_3$.

From the fourth press 74 the web W is guided further through a free draw $F_2$ onto a transfer roll 68 and further into the dryer section.

The web is passed further from said second transfer roll 68 into the dryer section R into its first dryer group $R_2$ onto the first drying cylinder 20 in said group along with the bottom face of the wire 22 of the single-wire draw while the web is supported by a vacuum produced by a blow box 69.

In FIGS. 1 and 2, in accordance with the invention, in connection with the first drying cylinders 20 in the initial part of the dryer section, devices 91 for measurement of the surface temperatures of said cylinders have been fitted. Besides this, before the first drying cylinders, measurement devices 92 have been fitted for measurement of the temperature and of the moisture/dry solids of the paper web W. From the prior art, for example, various infrared-based measurement apparatuses not contacting the web are known for this purpose. From these measurements, there is a connection through a control unit 93 to the press section 10 for regulation of the press loads and/or of the steam box/boxes 81, 82 in the press section and/or for regulation of the impingement drying unit $R_1$. In addition to this, based on the measurement results, the steam pressures in the firs t cylinders 20 are regulated so as to reach the desired surface temperatures by means of regulation 95 of the steam pressures.

As is shown in FIGS. 1 and 2, the surface temperatures of the first drying cylinders 20 in the dryer section R are measured by means of the measurement apparatuses 91, and the temperature and the dry solids/moisture of the paper web are measured by means of the measurement apparatus 92 before the first drying cylinders 20, and based on the measurement results, by means of the control unit 93, the surface temperatures of the first drying cylinders 20 are regulated to the desired level by means of regulation 95 of steam pressure. Further, it is possible to regulate the blow parameters of the impingement drying unit (FIG. 1) and/or the press loads in the presses 71,72,73, 74 and/or the steam boxes 81,82 and the differences in speed 94 between the dryer groups. The measurement apparatuses can be, for example, apparatuses in themselves known based on IR measurements or corresponding suitable measurement apparatuses.

In a situation in which there has been a web break in the paper web and threading is carried out, the steam pressures in the first cylinders 20 are lowered in the first dryer group $R_2$, and the temperature of the impingement drying hood $R_1$ (FIG. 1) is also lowered. After this, the surface temperatures of the first drying cylinders 20 are regulated to a suitable level by means of regulation 95 of steam pressures by means of the control unit 93, and likewise, in the exemplifying embodiment shown in FIG. 1, the blow parameters of the impingement drying hood $R_1$ are regulated based on the results obtained from the measurements of the surface temperatures of the drying cylinders 20 by means of the measurement apparatus 91. In the regulation, it is possible to use the measurement results obtained from the apparatus 92 for measurement of the dry solids/moisture of the web. Based on the measurement results, if desired, it is also possible to regulate the press loads in the presses 71,72,73, 74 in the press section 10 in order to obtain a correct moisture for the lead-in strip, and, further, in the regulation operations, it is possible to employ regulation of the steam boxes 81,82 in the press section 10. Further, the measurement results can be used as an aid when the differences in speed 94 between the dryer groups in the dryer section are regulated.

Figure 3:
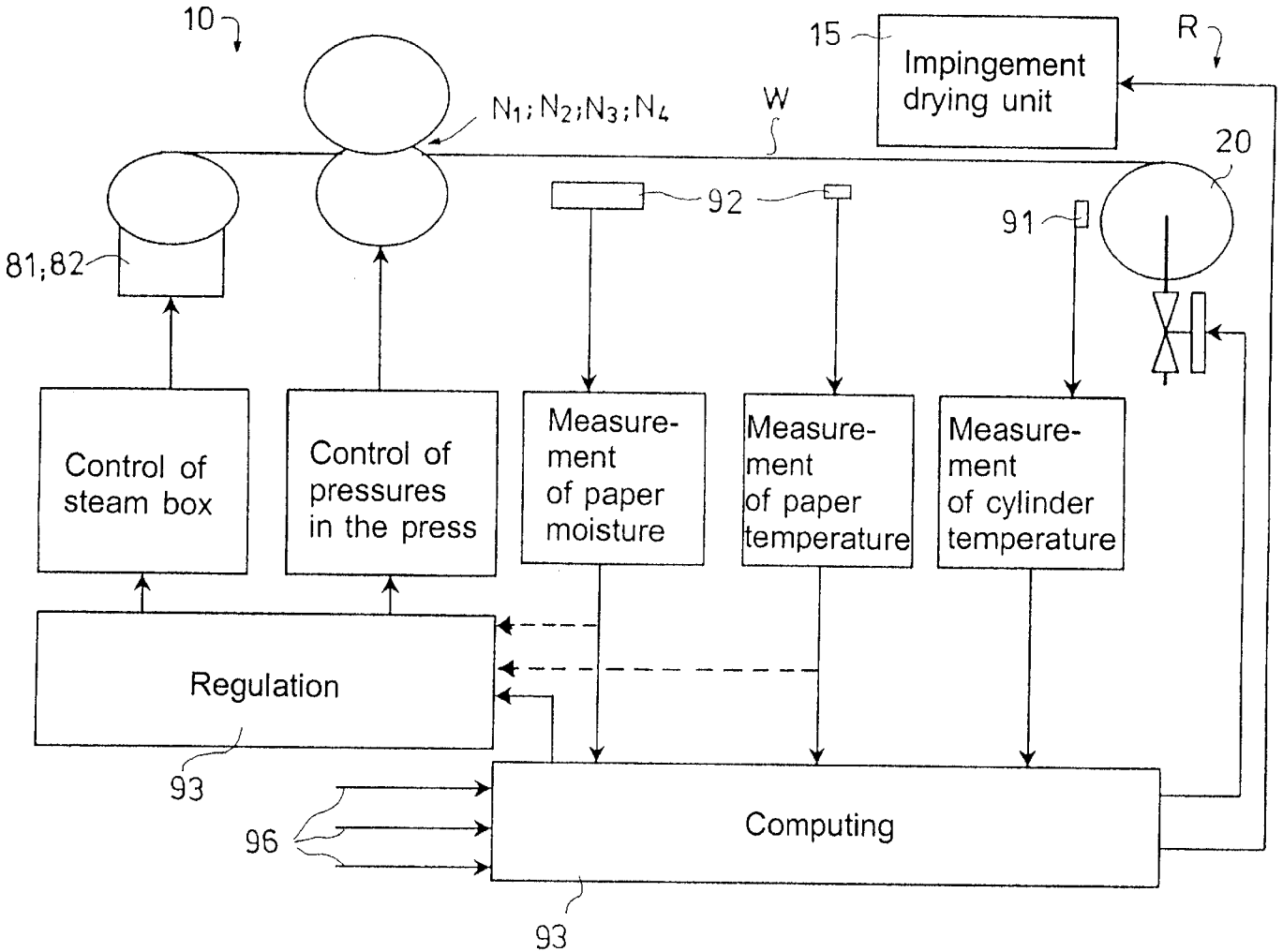
FIG. 3 is a schematic illustration of the arrangement in accordance with the invention.

FIG. 3 is a schematic illustration of the arrangement in accordance with the invention. Said illustration shows the steam box 81;82 in the press section 10, the press nip $N_1$;$N_2$;$N_3$;$N_4$, of which there can, of course, be several, apparatuses 92 for measurement of the moisture and the temperature of the paper before the first cylinder 20, as well as a possible impingement drying unit 15 and the first drying cylinder 20. Of course, the steam box 81;82 of the press 10 can be controlled directly on the basis of the measured moisture and temperature data (dashed line), but in addition to this they can be regulated by using a control based on a computing model as an aid, in which control the parameters 96 include, among other things, machine speed, stock data, basis weight, etc. This program attempts to optimize the runnability of the dryer section R, while taking into account possible criteria of quality, if any, by means of said differences in moisture and temperature and by means of the surface temperature of the cylinder measured by means of the measurement apparatus 91. In the case shown in the figure, the actuators that can be regulated are the surface temperature of the cylinder 20, capacity of the impingement drying 15, and the steam box 81;82 of the press 10 and the press loads. As the optimizing algorithm it is possible to use any prior-art method whatsoever provided that the effects of said parameters are known, for example, based on an empiric or computed model.

According to a preferred embodiment of the invention, a model-predictive multi-variable regulation and/or optimization is/are employed. The input parameters of the model are the capacity of the steam box, the press load and/or any other control parameter that affects the drying capacity, the heating capacity of the impingement drying unit (flow speed and/or temperature), and/or the heating capacity of the first cylinder (pressure or equivalent). The output parameters of the model are moisture and/or temperature of the web after the press and/or temperature of the first cylinder.

Above, the invention has been described with reference to some preferred exemplifying embodiments of same only, the invention being, however, not supposed to be in any way strictly confined to the details of said embodiments. Many variations and modifications are possible within the scope of the inventive idea defined in the following patent claims.

We claim:

1. A method for regulation of the initial part of the dryer section in a paper machine having a press section in which moisture is removed from the paper web, and a dryer section in which the paper web is dried, and in which the paper web is passed from the press section into a first group of first drying cylinders forming a part of the dryer section, in which the paper web is dried against heated faces of the drying cylinders, the method comprising the steps of:

measuring the surface temperatures of the first drying cylinders of the first group of drying cylinders in the dryer section;

measuring the dry solids content/moisture content of the paper web and the temperature of the paper web upstream of said first drying cylinders, and in view of producing the desired running situation, based on the measured surface temperatures and dry solids content/moisture contents, regulating the surface temperatures of the first drying cylinders, the dry solids content/moisture content, and the temperature of the paper web before said first drying cylinders.

2. The method of claim 1 wherein, based on said measurements, the difference between the surface temperatures of the first drying cylinders of the first group of drying cylinders and the web temperature is regulated to a level lower than a preset value or a value determined by means of computing on the basis of the measurement results.

3. The method of claim 1 wherein, based on said measurements, the surface temperatures of the first cylinders are regulated to a level lower than the sum of the measured web temperature and a predetermined temperature or a temperature determined by means of computing.

4. The method of claim 1 wherein, based on said measurements, the temperature of the web is regulated to a level higher than the difference between the measured surface temperatures of the first cylinders and a predetermined temperature or a temperature determined by means of computing.

5. The method of claims 1 wherein the paper web to be dried is passed from the press section to the dryer section over an impingement drying unit into the first group of drying cylinders, and based on said measurement results, blow parameters of the impingement drying unit are regulated.

6. The method of claim 1 wherein, based on said measurement results, regulating at least one of a press load of a press in the press section, and at least one steam box in the press section.

7. The method of claim 1 wherein an additional group of drying cylinders follows the first group of drying cylinders, and wherein, based on said measurement results, regulating the difference of draw between the press section and the dryer section as well as the differences in draw between the first cylinders and the additional group of drying cylinders.

8. The method of claim 1 wherein an additional group of drying cylinders follows the first group of drying cylinders, and wherein, based on said measurement results, regulating the difference of draw between the first cylinders and the additional group of drying cylinders.

9. The method of claim 1 wherein reversing suction rolls are positioned between adjacent pairs of first drying cylinders, each reversing suction roll having a level of vacuum, and wherein a blow or suction box is positioned above each reversing suction roll, and, based on at least one of said measurements, controlling the level of vacuum in the reversing suction rolls, the capacity of the blow or suction box, or both.

10. The method of claim 1, further comprising the step of employing a multi-variable regulation and optimizing method, wherein the at least one input variable is selected from the group consisting of:

the capacity of the steam box;

the press load;

the capacity of the impingement drying; and the heating capacity of the first cylinder; to thereby maintain the moisture content of the web and the temperature of the web and the temperature of the first cylinder at the desired level.

11. The method of claim 1 further comprising the step of optimizing at least one of the web moisture content and the press load, and differences in temperature between drying cylinders and the web temperature are optimized by adjusting at least one of the heating capacity of an impingement drying unit fitted before the first drying cylinders and the heating capacity of the first cylinder itself.

12. The method of claim 1 wherein, for the purpose of threading after a web break in the paper web, the surface temperatures of said first drying cylinders not covered by the web are measured, and, based on the measurement results obtained, regulating at least one of the surface temperatures of said first drying cylinders, the press load in at least one press in the press section, the levels of the steam boxes in the press section, and the blow parameters of the impingement drying unit, in order to provide a desired threading situation.

13. The method of claim 1 wherein the temperatures of said first drying cylinders are regulated after a web break by means of a separate steam valve and by means of a supply of water produced out of a cooling cylinder.

14. The method of claim 1 wherein the temperatures of said first drying cylinders are regulated after a web break by means of a supply of water produced out of a cooling cylinder.

15. The method of claim 13 wherein condensate obtained from a condenser of a steam system is used as cooling water.

16. The method of claim 14 wherein condensate obtained from a condenser of a steam system is used as cooling water.

17. An apparatus for regulation of the initial part of the dryer section in a paper machine having a press section and a dryer with a plurality of first drying cylinders, the apparatus comprising:

measurement devices fitted in connection with the first drying cylinders in the dryer section for measurement of the surface temperatures of said first drying cylinders;

a measurement device for measurement of the dry solids content/moisture content of the paper web and of the temperature of the paper web before said first drying cylinders; and a control device for regulation of at least one of
the surface temperatures of said first drying cylinders,
the dry solids content/moisture content, and the temperature of the paper web before said first drying cylinders, based on the measurement results obtained by means of the measurement devices, so as to produce the desired running situation.

18. The apparatus of claim 17 wherein the control device of the equipment comprises means for regulation on the basis of said measurement results obtained from the measurement devices of at least one of the press load in at least one press in the press section;

the steam box/boxes;

the impingement drying unit fitted before said first drying cylinders; and the differences of draw between the first groups of drying cylinders in the dryer section on the basis of said measurement results obtained from the measurement devices.

19. The apparatus of claim 17 wherein paper machine has reversing suction rolls between pairs of the first drying cylinders, each suction roll having a level of vacuum applied, and a blow or suction box is positioned to act on at least one of the first drying cylinders and the apparatus further comprises a controller for regulation of the vacuums in the reversing suction rolls, and the capacity of the at least one blow or suction box.

20. The apparatus of claim 17 wherein the equipment has been fitted to be used during threading taking place after a web break in the paper web so as to provide the desired threading situation.

21. The apparatus of claim 17 wherein the equipment comprises a control unit for keeping the difference between the surface temperatures of the first cylinders and the web temperature below a preset value or a value determined on the basis of the measurement results.

* * * * *